US005157307A

United States Patent [19]

Noda

[11] Patent Number: 5,157,307

[45] Date of Patent: Oct. 20, 1992

[54] SEWING MACHINE DRIVE APPARATUS

[75] Inventor: Hiromitsu Noda, Katano, Japan

[73] Assignee: Matsushita Electric Industrial Co., Ltd., Kadoma, Japan

[21] Appl. No.: 465,137

[22] PCT Filed: Jun. 22, 1989

[86] PCT No.: PCT/JP89/00624

§ 371 Date: Feb. 22, 1990

§ 102(e) Date: Feb. 22, 1990

[87] PCT Pub. No.: WO89/12709

PCT Pub. Date: Dec. 28, 1989

[30] Foreign Application Priority Data

Jun. 23, 1988 [JP] Japan ..... 63-155245

[51] Int. Cl.[5] ..... H02P 3/24

[52] U.S. Cl. ..... 318/372; 112/275

[58] Field of Search ..... 112/277, 275; 318/759-762, 375, 372; 361/194, 196, 205

[56] References Cited

U.S. PATENT DOCUMENTS

| | | | |
|---|---|---|---|
| 4,161,919 | 7/1979 | Nishida et al. | 112/275 |
| 4,351,254 | 9/1982 | Brown | 112/275 |
| 4,403,563 | 9/1983 | Shinozaki et al. | 112/275 |
| 4,627,370 | 12/1986 | Nakamura | 112/275 |
| 4,714,039 | 12/1987 | Shimada | 112/275 |

*Primary Examiner*—David Smith, Jr.

*Attorney, Agent, or Firm*—Cushman, Darby & Cushman

[57] ABSTRACT

A sewing machine drive apparatus having a first and second rectifying circuit connected to an AC power source, and a sewing machine control circuit for outputting a drive signal and for outputting a voltage control signal after a certain time period has elapsed from outputting said drive signal. A motor drive circuit is connected to the first rectifying circuit for driving a motor. A DC/DC converter solenoid power source circuit is connected to the second rectifying circuit for outputting a rated voltage of a solenoid, and for outputting a hold voltage to hold the solenoid in response to a voltage control signal. A solenoid drive circuit inputs the output of the DC/DC converter solenoid power circuit in response to a drive signal to drive the solenoid.

4 Claims, 5 Drawing Sheets

SEWING MACHINE DRIVE APPARATUS

TECHNICAL FIELD

The present invention relates to a sewing machine drive apparatus having a power source circuit for driving a solenoid of a sewing machine for industrial use.

BACKGROUND ART

A conventional example is shown in FIG. 4 and elucidated.

Numeral 1 designates an AC power source, numeral 6 designates a sewing machine control circuit, numeral 7 designates a rectifying-smoothing circuit, numeral 9 designates a solenoid drive circuit, numeral 10 designates a solenoid, numeral 11 designates a transformer, and numeral 12 designates a chopping control circuit.

With regard to the sewing machine drive apparatus constituted as mentioned above, its operation is described referring to FIG. 5.

The AC power source 1 is transformed to a rated input voltage of the solenoid 10 by the transformer 11. The output of transformer 11 is smoothed by the rectifying-smoothing circuit 7, thereby a solenoid power source is made. A solenoid drive signal of the sewing machine control circuit 6 is received by the solenoid drive circuit 9. The solenoid 10 is driven by taking said solenoid power source as an input. After an elaspe of a time period, a chopping signal of a certain frequency from said sewing machine control circuit 6 is received by the chopping control circuit 12; and thereby, output voltage of the solenoid 10 is controlled and output current of the solenoid is reduced.

However, in the convention power source above, after driving and holding the solenoid, when chopping control is executed on the output voltage by the chopping control circuit 12 for holding the solenoid by the chopping control circuit 12, an acoustic noise of chopping sound (frequency of the chopping signal) is generated giving unpleasant feeling to a user.

DISCLOSURE OF THE INVENTION

The purpose of the present invention is, to provide a sewing machine drive apparatus which eliminates acoustic noise and can set a voltage for holding a solenoid.

This purpose is achieved by apparatus in accordance with the present invention which has an output voltage of a DC/DC converter solenoid power source circuit used as a power source of a solenoid, uses a DC power source direct rectification and smoothing of an AC power source as an input, and controls the voltage of the power source by a voltage control signal from a sewing machine control circuit.

The present invention can, by constituting the solenoid power source circuit by DC/DC type converter, control the voltage control signal of the sewing machine control circuit freely by an output voltage control circuit in the solenoid power source circuit.

BEST MODE FOR EMBODYING THE INVENTION

Figure 1:
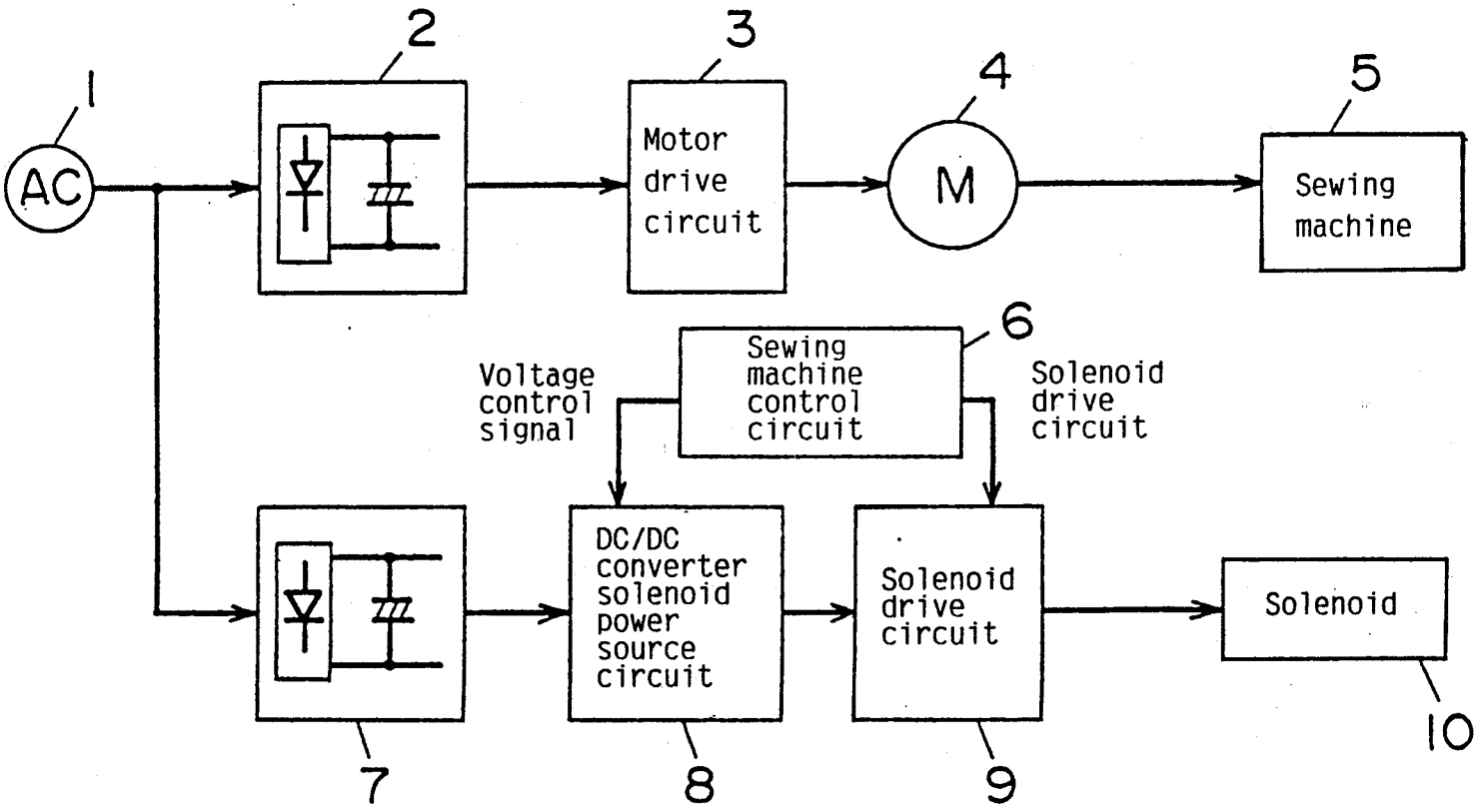
FIG. 1 is a block diagram of a sewing machine drive apparatus in a first embodiment in accordance with the present invention.

Hereafter, a first embodiment in accordance with the present invention is described referring to the drawings.

FIG. 1 shows a sewing machine drive apparatus in the first embodiment in accordance with the present invention.

In FIG. 1, numeral 1 designates an AC power source, numeral 2 designates a first rectifying-smoothing circuit, numeral 3 designates a motor drive circuit, numeral 4 designates a synchronous motor, numeral 5 designates a sewing machine, numeral 6 designates a sewing machine control circuit having a voltage control circuit for controlling the output voltage of the solenoid power source circuit 8, numeral 7 designates a second rectifying-smoothing circuit, numeral 8 designates a DC/DC converter/solenoid power source circuit, numeral 9 designates a solenoid drive circuit, and numeral 10 designates a solenoid. In respect of the sewing machine apparatus of the first embodiment which is constituted as mentioned above, its operation is described in the following referring to FIG. 1 and FIG. 2.

A voltage agreeing with a rated voltage of the solenoid is output from the DC/DC converter/solenoid power source circuit 8. The solenoid power source circuit 8 receives an output of a DC power source from the second rectifying-smoothing circuit 7 connected to the AC power source 1. A solenoid drive signal is transmitted to the solenoid drive circuit 9 from the sewing machine control circuit 6. The solenoid 10 is driven by inputting voltage of the solenoid power source circuit 8. A voltage control signal is transmitted to the solenoid power source circuit 8 from the sewing machine control circuit 6 after an elapse of a certain time period. The voltage control signal controls the voltage control circuit of solenoid power source circuit 8. Therefore, the voltage of the solenoid power source circuit 8 supplying power to the solenoid drive circuit 9 can be controlled.

As mentioned above, according to the present embodiment, by providing the DC/DC converter/-solenoid power source circuit 8, and controlling the voltage of the DC/DC converter solenoid power source circuit 8 (by controlling the voltage control circuit in the power source circuit 8 with the voltage control signal from the sewing machine control circuit 6), an acoustic noise (chopping sound) during a voltage control operation for reducing solenoid output current in holding of the solenoid can be eliminated.

Also, since a voltage for holding the solenoid can be controlled freely, control can be executed by outputting a voltage agreeing with the kind of voltage by which the solenoid can be held.

For example, a kind of the solenoid is driven by 40 V and held by 20 V. And, as another kind of the solenoid can be controlled so as to be driven by 40 V and held by 10 V, very effective voltage control can be.

Figure 3:
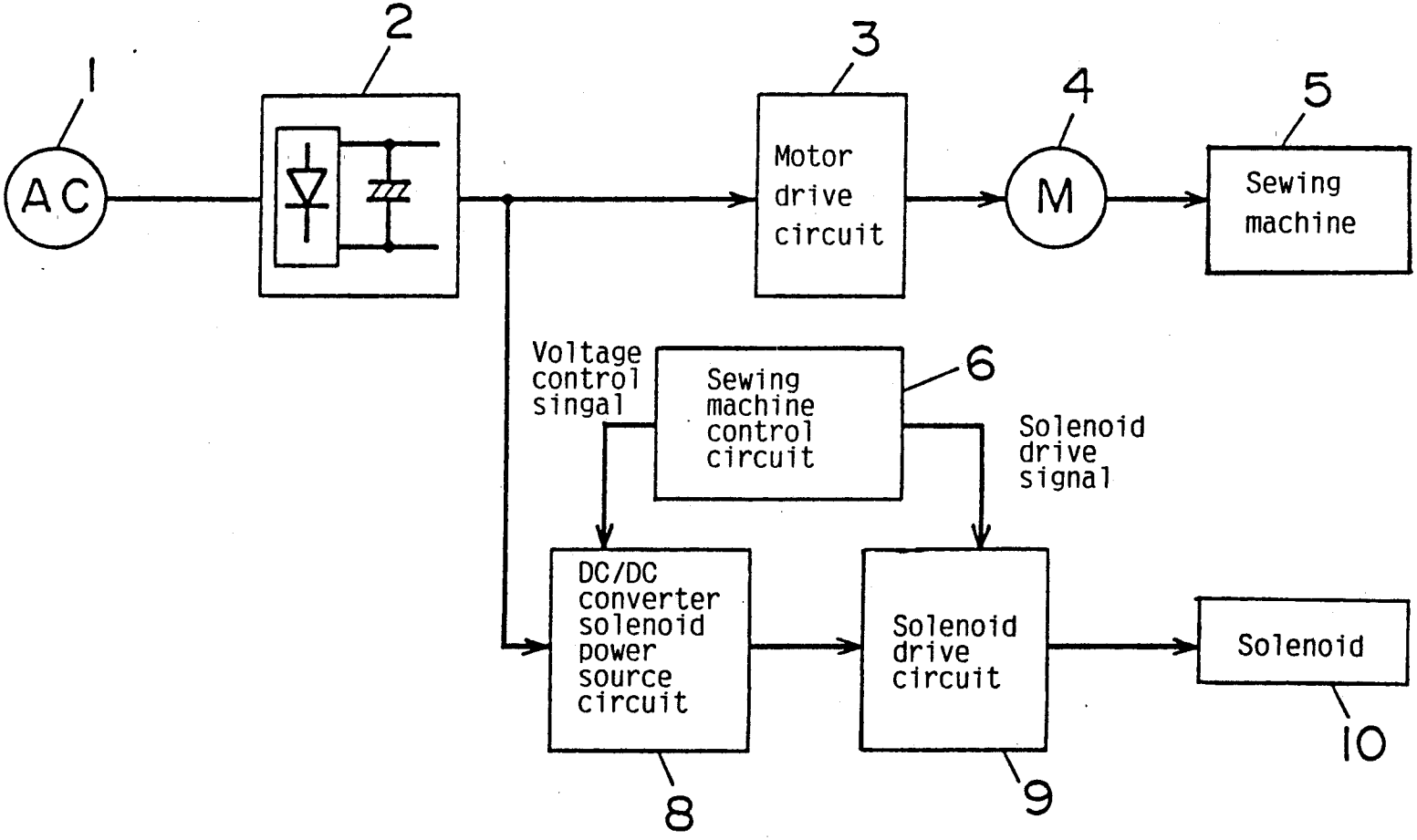
FIG. 3 is a block diagram of a sewing machine drive apparatus in a second embodiment in accordance with the present invention.
Figure 4:
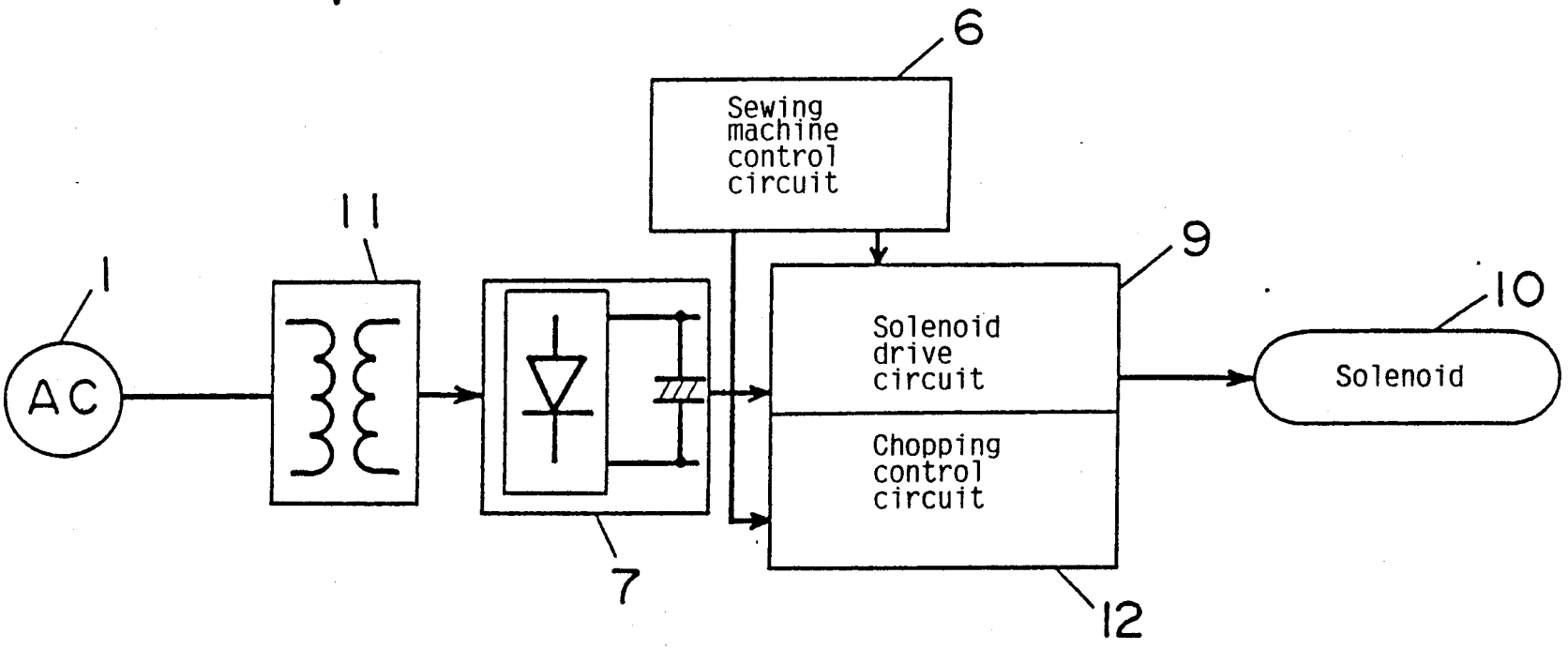
FIG. 4 is the block diagram of the conventional sewing machine drive apparatus.
Figure 5:
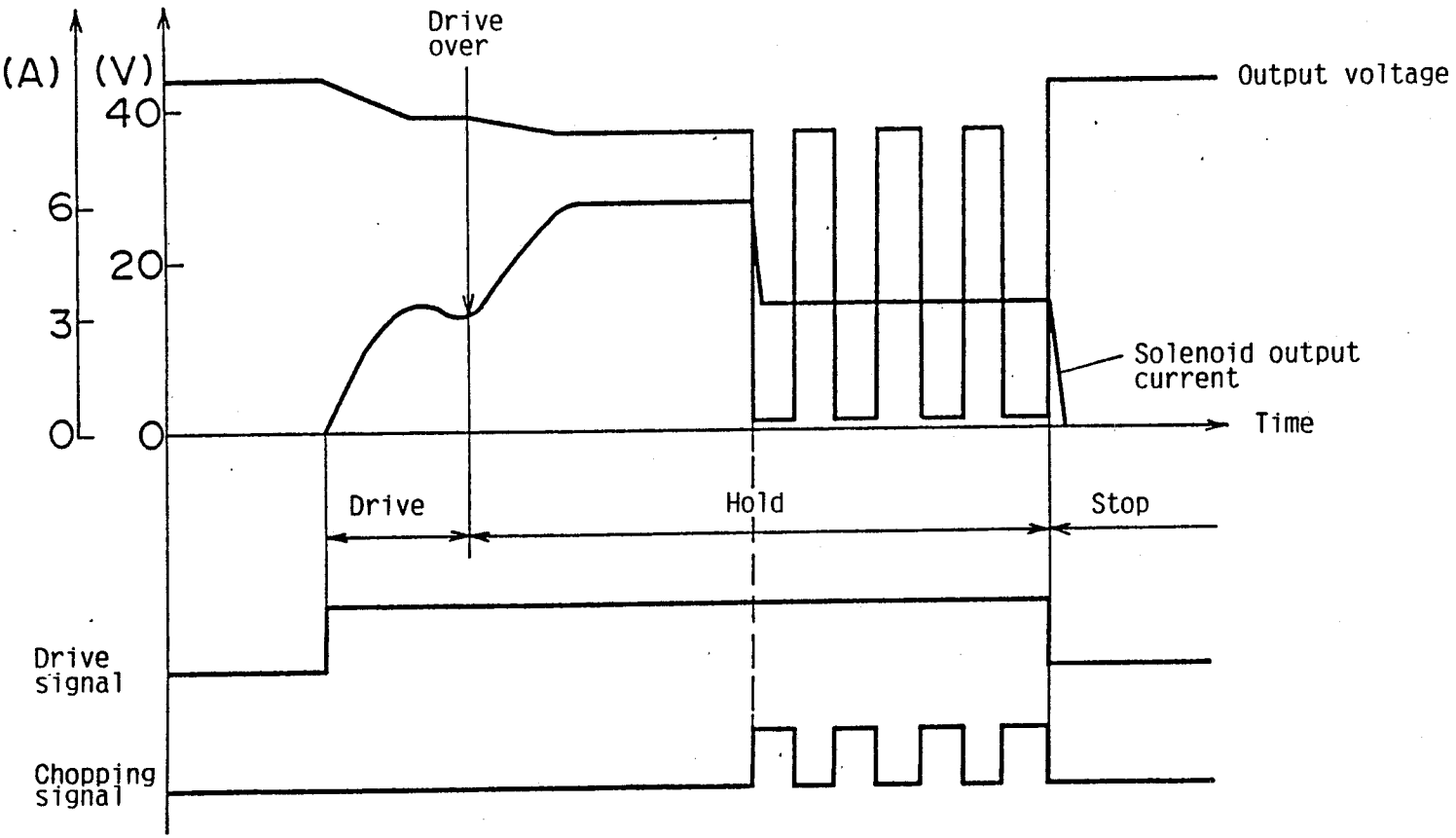
FIG. 5 is the time chart of deriving characteristics of the solenoid of the conventional sewing machine drive apparatus.

FIG. 3 shows a sewing machine drive apparatus in a second embodiment in accordance with the present invention.

In FIG. 3, numeral 1 designates an AC power source, numeral 2 designates a rectifying-smoothing circuit for the AC power source 1, numeral 3 designates a motor drive circuit, numeral 4 designates a synchronous motor, numeral 5 designates a sewing machine, numeral 6 designates a sewing machine control circuit, numeral 8 designates a DC/DC converter/solenoid drive circuit (SIC) having a voltage control circuit, and numeral 10 designates a load of a solenoid. The above-mentioned elements are similar to those of the constitution in FIG. 1, and the different point from the constitution in FIG. 1 is omission of the second rectifying-smoothing circuit 7.

Figure 2:
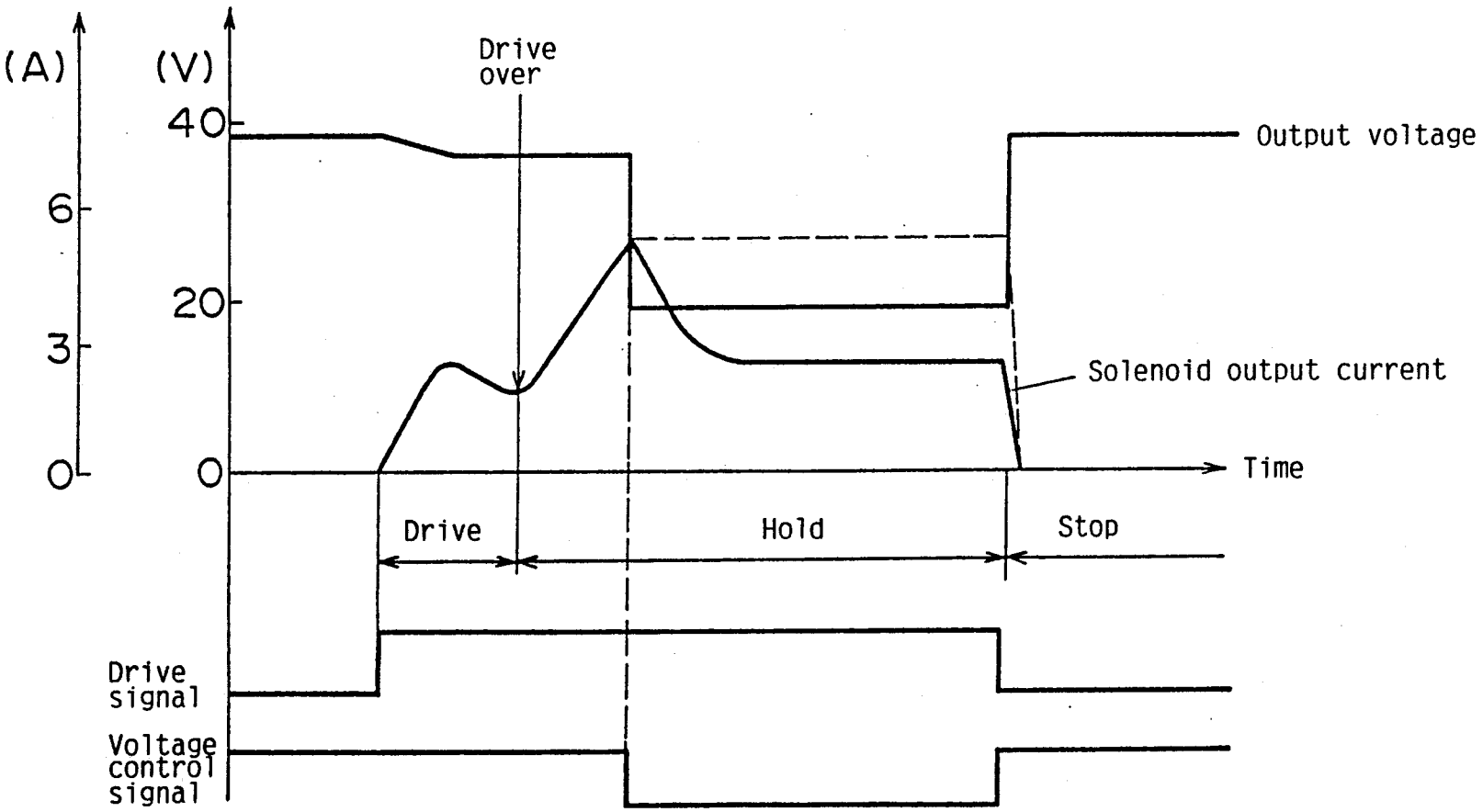
FIG. 2 is a time chart showing drive characteristics of solenoid of the sewing machine drive apparatus in accordance with the present invention.

In respect of the sewing machine drive apparatus of the second embodiment which is constituted as mentioned above, the following operation is described with further referring to FIG. 2.

A voltage on a rated voltage of the solenoid is output from the DC/DC converter/solenoid power source circuit 8 which takes as input, output of a DC power source from the rectifying-smoothing circuit 2 connected to the AC power source 1. The solenoid drive signal is transmitted to the solenoid drive circuit 9 from the sewing machine control circuit 6. The solenoid 10 is driven by inputting a voltage of said solenoid drive circuit 9. After an elapse of a certain time period, a voltage control signal from the sewing machine control circuit 6 is received by a voltage control circuit which is contained in the solenoid power source circuit 8, and thereby the voltage of the solenoid power source can be controlled.

As mentioned above, according to the present embodiment, by providing the DC/DC converter/-solenoid power source which takes an output voltage of the rectifying-smoothing circuit 2 for main electric power source connected to the AC power source as input, and by controlling the voltage of the solenoid power source and the voltage control signal from the sewing machine drive (SIC) circuit 6, by the voltage control circuit contained in said power source circuit 8 (SIC), the same effect as that of the first embodiment can be obtained, elimination of acoustic noise.

POSSIBLE UTILITY IN INDUSTRY

As mentioned above, the present invention, provides the DC/DC converter solenoid power source which takes an output voltage of a rectifying-smoothing circuit connected to an AC power source as input, and can control an output voltage of solenoid by voltage control signal from a sewing machine control circuit, so that output current of the solenoid in holding of the solenoid is reduced and an acoustic noise in voltage control can be eliminated, and, since a voltage in the voltage control can freely be controlled, more effective solenoid holding current can be limited (SIC).

I claim:

1. A sewing machine drive apparatus comprising:
   - a first rectifying circuit connected to an AC power source;
   - a motor drive circuit connected to said first rectifying circuit for driving a motor;
   - a second rectifying circuit connected to said AC power source;
   - a sewing machine control circuit for outputting a drive signal and for outputting a voltage control signal after a certain time period has elapsed from outputting said drive signal;
   - a DC/DC converter solenoid power source circuit connected to said second rectifying circuit for outputting a rated voltage of a solenoid, and for outputting a hold voltage to hold said solenoid in response to a voltage control signal; and
   - a solenoid drive circuit for inputting the output of said DC/DC converter solenoid power circuit in response to a drive signal to drive said solenoid.

2. A sewing machine drive apparatus according to claim 1, wherein said DC/DC converter solenoid power source circuit comprises an output voltage control circuit for controlling the output voltage of said DC/DC converter solenoid power source circuit in response to said voltage control circuit.

3. A sewing machine drive apparatus comprising:
   - a rectifying circuit connected to an AC power source;
   - a motor drive circuit connected to said first rectifying circuit for driving a motor;
   - a sewing machine control circuit for outputting a drive signal and for outputting a voltage control signal after a certain time period has elapsed from outputting said drive signal;
   - a DC/DC converter solenoid power source circuit connected to said rectifying circuit for outputting a rated voltage of a solenoid, and for outputting a hold voltage to hold said solenoid in response to a voltage control signal; and
   - a solenoid drive circuit for inputting the output of said DC/DC converter solenoid power circuit in response to a drive signal to drive said solenoid.

4. A sewing machine drive apparatus according to claim 3, wherein said DC/DC converter solenoid power source circuit comprises an output voltage control circuit for controlling the output voltage of said DC/DC converter solenoid power source circuit in response to said voltage control circuit.

* * * * *